US006976857B1

(12) United States Patent
Shukla et al.

(10) Patent No.: US 6,976,857 B1
(45) Date of Patent: Dec. 20, 2005

(54) COMPACT GROUND CLAMP

(75) Inventors: Shuklesh Shukla, Jaipur (IN); Krishnan S. Iyer, Cary, NC (US); Neville N. Kharas, Cary, NC (US)

(73) Assignee: Sigma Electric Manufacturing Corp., Garner, NC (US)

( * ) Notice: Subject to any disclaimer, the term of this patent is extended or adjusted under 35 U.S.C. 154(b) by 0 days.

(21) Appl. No.: 11/160,886

(22) Filed: Jul. 14, 2005

(51) Int. Cl.[7] ..... H01R 12/00
(52) U.S. Cl. ..... 439/100
(58) Field of Search ..... 439/100, 92, 810, 439/814, 804

(56) References Cited

U.S. PATENT DOCUMENTS 2,116,776 A * 5/1938 Bondeson ..... 439/804
2,533,897 A * 12/1950 Reddock ..... 439/804
3,892,455 A * 7/1975 Sotolongo ..... 439/100
3,901,577 A * 8/1975 Philibert et al. ..... 439/804
3,988,052 A * 10/1976 Mooney et al. ..... 439/804
4,159,859 A * 7/1979 Shemtov ..... 439/100
4,863,390 A * 9/1989 Cera et al. ..... 439/100
5,752,860 A * 5/1998 Greaves ..... 439/781
5,772,455 A * 6/1998 Auclair et al. ..... 439/100
2004/0092142 A1 * 5/2004 Clark et al. ..... 439/100

* cited by examiner

*Primary Examiner*—Tulsidas C. Patel
*Assistant Examiner*—Harshad C. Patel
(74) *Attorney, Agent, or Firm*—Mills Law Firm PLLC

(57) ABSTRACT

A ground clamp having upper and lower clamp members interconnected by clamping screws for mechanical and electrical connection with a grounding member, and a frontally projecting boss on the lower clamp member having a downwardly opening slot for receiving a ground wire which is retained by a set screw forward of the clamping screws whereby the various screws may be independently tightened without interference from adjacent screws.

4 Claims, 5 Drawing Sheets

COMPACT GROUND CLAMP

FIELD OF THE INVENTION

The present invention relates to electrical connectors for ground wires and, in particular, a ground clamp for connecting a grounding wire to a parallel grounding member.

BACKGROUND OF THE INVENTION

Grounding connectors are used to electrically connect electrical devices to a grounding members, such as ground rods, pipe and rebar. Inasmuch as the connectors are typically installed underground or in limited access space, the compactness and ease of use are primary concerns. One prior art device for connecting a grounding wire to a parallel grounding member includes a pair of clamp members that are interconnected by clamping screws for clamping the ground member therebetween. A block is provided on the top clamp member having a transverse through hole for receiving the grounding wire. A vertical set screw is provided for clamping the grounding wire in the block. The upper vertical location of the block increases the overall envelope size of the ground clamp, in both the packaged and installed conditions. Such ground clamps are also disposed in serial locations along a grounding member. As it is desirable to use a continuous length of grounding wire, the grounding wire needed to be successively threaded through the block hole, a time consuming installation step.

The serial installation problem was partially overcome by the clamping apparatus for connecting ground wire to grounding member disclosed in U.S. Patent Application Publication No. US2004/0092142. Therein, as shown FIG. 7, the ground clamping apparatus 100 includes an upper clamp 102 connected to a lower clamp 104 by screws 106 to clamp a ground member therebetween. Instead of a hole through the block 108 on the upper clamp, an upwardly opening slot 110 is provided. Accordingly, the ground wire may be laid in the slot and a transverse set screw 112 tightened to clamp the ground wire in the slot. While assisting in the installation of the ground wire, the position on the upper block still increased the mounting envelop size. Further, the set screw and the clamping screws were in a common plane. To gain tool access to one of the clamping screws for uniform clamping, the set screw had to be in a retracted position in the ground wire block, otherwise the shank of the set screw physically interfered with took access to the clamping screw. For subsequent installation ground wire, the set screw had to be loosed and thereafter retightened, presenting an additional installation step. After ground wire attachment, the clamping screw was once again overlaid by the set screw, creating operational problems if the ground clamp needed repositioning or retightening.

SUMMARY OF INVENTION

The present invention provides a compact ground clamp for interconnecting a ground wire to a grounding member wherein upper and lower clamp members are attached by clamping screws for engaging the grounding member and wherein a ground wire boss projects forwardly from the lower clamp member and includes a downwardly opening slot that receives the grounding wire, which is clamped thereto by a set screw located in a plane axially spaced from the clamping screws. The forward and bottom axial position of the boss overcomes the above limitations of prior ground clamps by providing a more compact packaged and installed assembly, avoiding interference between the ground wire set screw and clamping screws, and allowing the set screw to be packaged in a retracted position to allow direct ground wire installation.

Accordingly, it is an object of the invention to provide a ground clamp that is more compact than current devices, both as packaged and installed.

Another object of the invention is to provide a ground clamp that avoids interference between the fasteners for connecting the grounding member and the ground wire.

A further object of the invention is to provide a ground clamp having a lay in ground wire mounting that can be conveniently accessed.

DESCRIPTION OF DRAWINGS

The above and other objects and advantages of the present invention will become apparent upon reading the following detailed description taken in conjunction with the accompanying drawings in which.

DETAILED DESCRIPTION OF THE PREFERRED EMBODIMENTS

Figure 1:
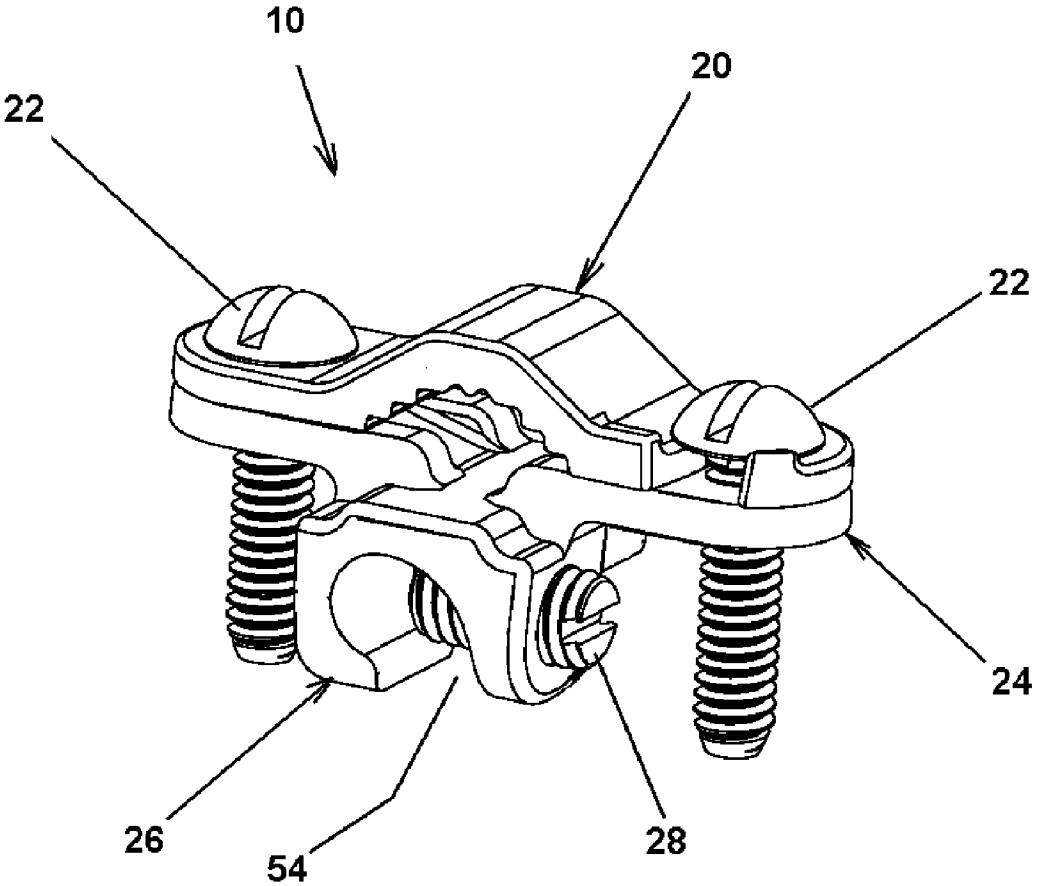
FIG. 1 is a front perspective view of a ground clamp in accordance with an embodiment of the invention.
Figure 2:
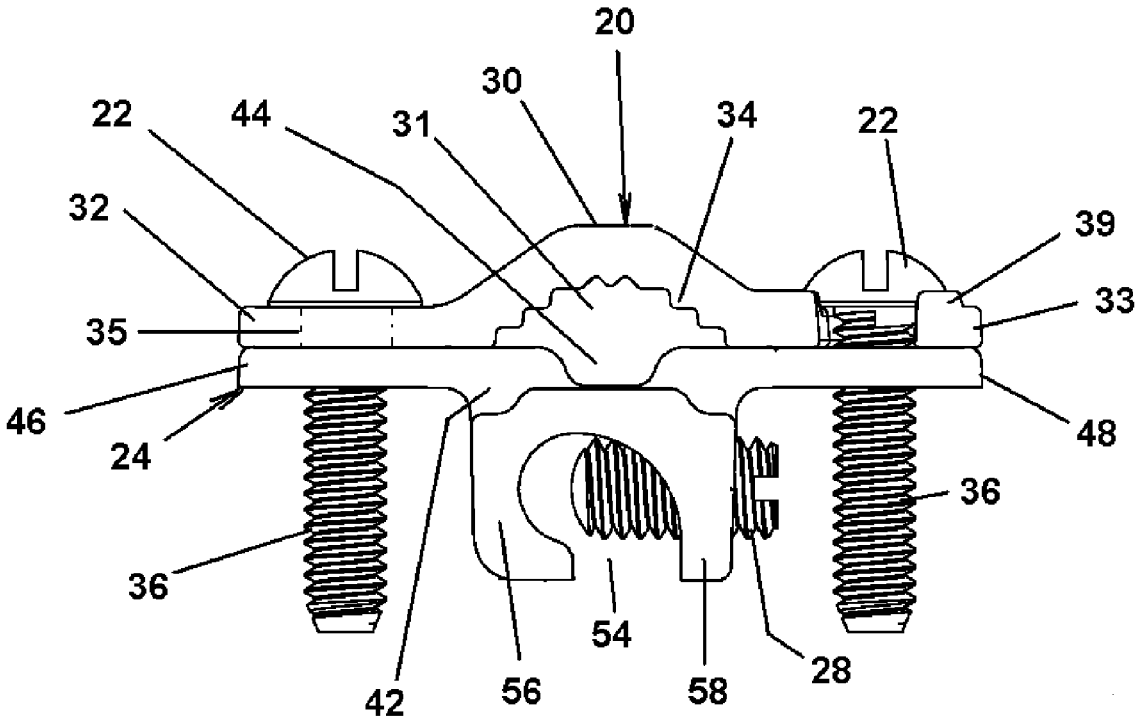
FIG. 2 is a front view of the ground clamp.
Figure 6:
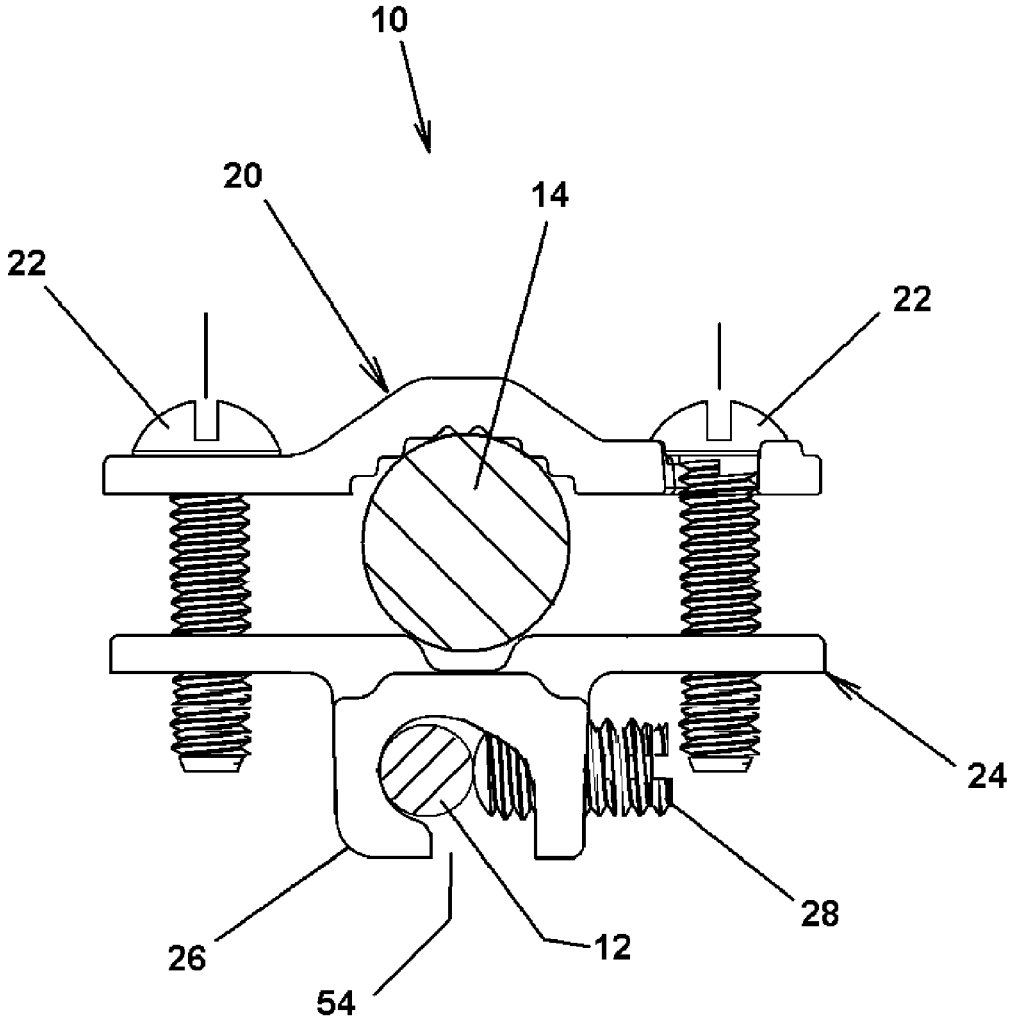
FIG. 6 is a front view of the ground clamp interconnecting a ground wire and a grounding member.
Figure 7:
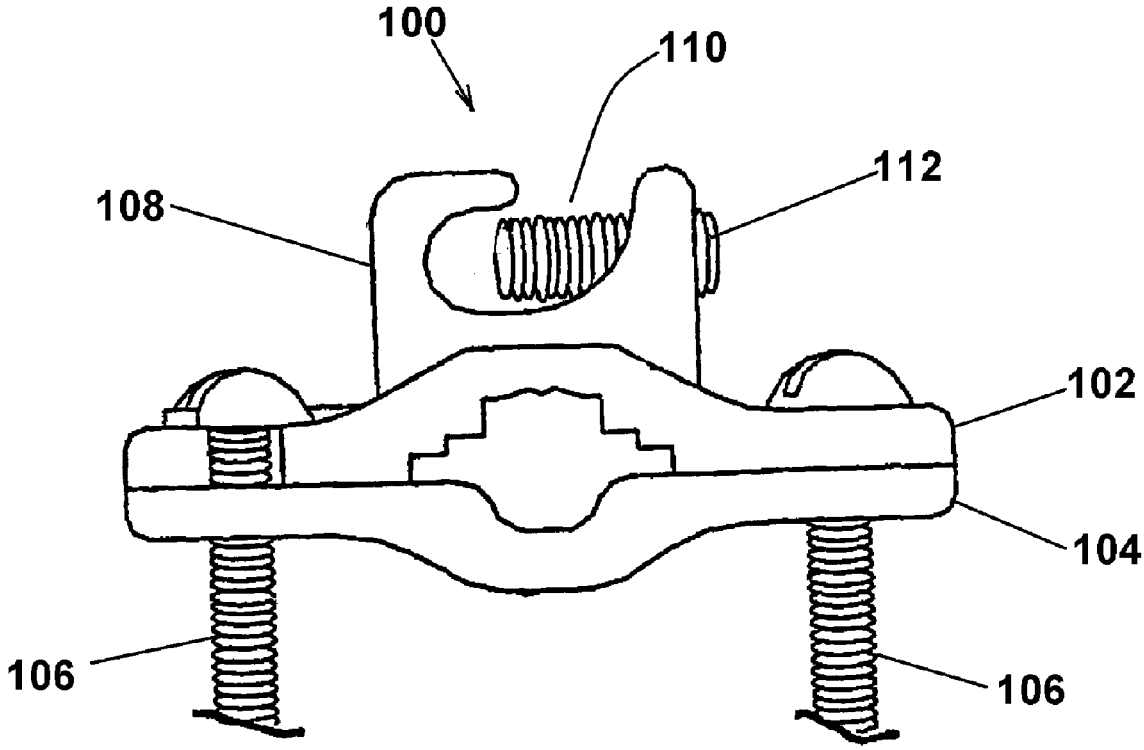
Prior Art FIG. 7
FIG. 7 is a front view of a prior art ground clamp.

Referring to the FIGS. 1 and 6, there is shown a ground clamp 10 for establishing a grounding relationship between a ground wire 12 connected with electrical devices to be grounded, and a buried parallel grounding member 14, such as rebar, pipe or ground rod.

The ground clamp 10 comprises an upper clamp member 20 connected by threaded clamping screws 22 to a lower clamp member 24 for clamping the grounding member 14 therebetween. The lower clamp member 24 includes a slotted ground wire boss 26 carrying the ground wire 12, which is releasably clamped therein by set screw 28. The clamp members are conventionally formed of suitable conductive material such as copper alloys. The ground clamp is configured to handle a customary range of ground wire and grounding member sizes. The range for the ground wire would typically be #10 through #2. The clamp would typically accommodate rigid conduit, copper tubing, and rebar from ⅜ inch to ¾ inch diameter.

Referring to FIGS. 2 through 5, the upper clamp member 20 includes an inverted V-shaped center section 30 having a downwardly opening transverse groove 31 laterally bounded by end sections 32, 33 having rounded ends. The inclined and top inner surfaces of the groove 32 of the center section 30 include transverse ribs 34 for accentuating mechanical and electrical contact with the grounding member 14 in assembly. The end section 32 includes a vertical through hole 35 for slidably receiving the shank 36 of the screw 22. The end section 33 includes a forwardly opening slot 38, for slidably receiving the shank 36 of the other clamping screw 22 and permitting rotation of the upper clamp member 20 about the end section 32 in preliminary assembly. An upwardly projecting tang 39 is formed on the top surface of the end section 33 adjacent the outer side of the slot 38. The tang 39 engages the head 40 of the clamping screw 22 to function as a stop thereby preventing relative clamp member rotation in preliminary and final assembly.

The bottom clamp member 24 includes a truncated V-shaped center section 42 having an upwardly opening groove 44 laterally bounded by end sections 46, 48 with rounded ends and underlying the end sections 32, 33 of the upper clamp member 20 in assembly. The end sections 46, 48 include threaded holes registering with the hole 35 and the slot 38 of the upper clamp member 20 for threadably receiving the shanks 36 of the clamping screws 22.

Figure 3:
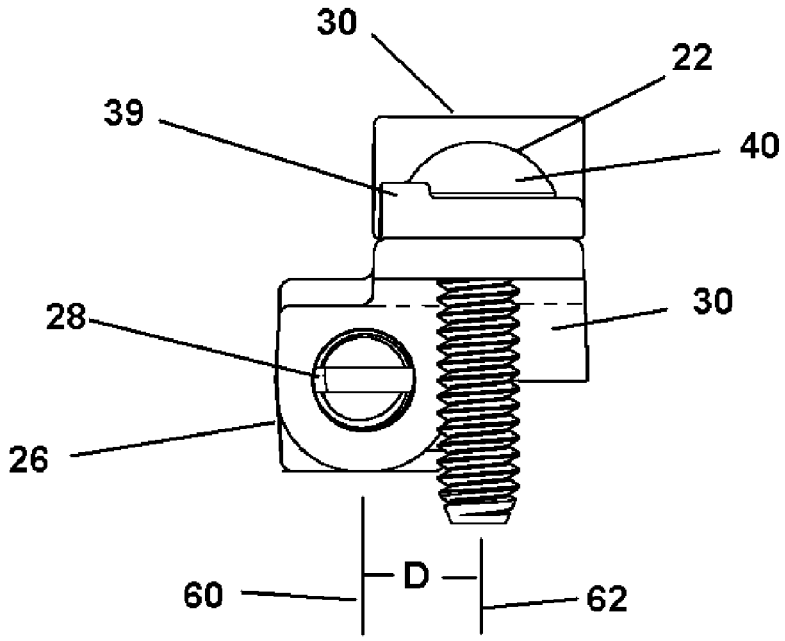
FIG. 3 is a right side view of the ground clamp.
Figure 4:
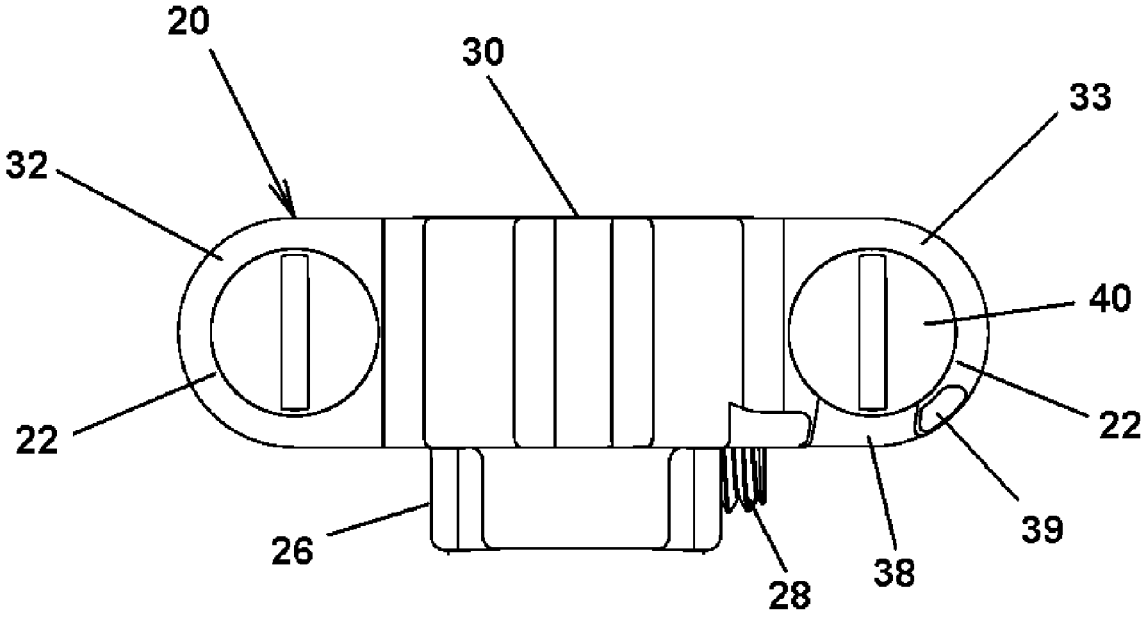
FIG. 4 is a top view of the ground clamp
Figure 5:
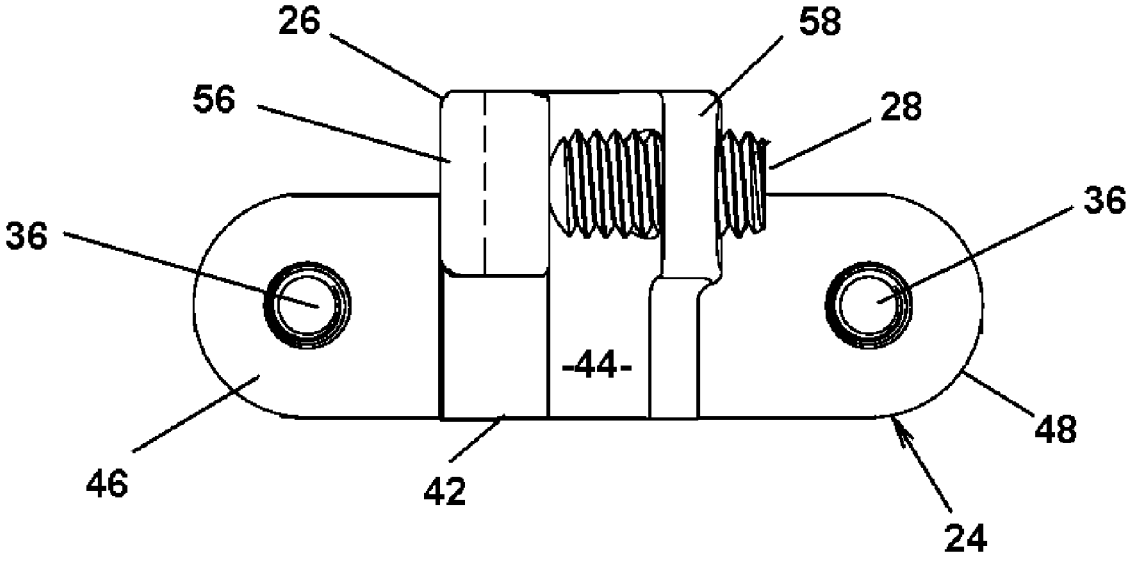
FIG. 5 is a bottom view of the ground clamp.

The boss 26 projects axially from the front of the center section 42 of the lower clamp 24. The boss 26 has a top surface coextensive with the base of the groove 44. The boss 26 includes a downwardly opening transverse J-shaped slot 54 bounded by side walls 56, 58 and parallel to the grooves in the clamp members. The inner surfaces of the side walls 56, 58 are laterally spaced to form a downwardly opening slot entrance for permitting insertion of ground wires of common sizes. The side wall 56 includes a recessed semi-circular inner wall. The side wall 58 includes a curvilinear inner wall merging the inner wall of side wall 56. The side wall 58 is laterally tapped for receiving the threaded shank of the set screw 28. As shown in FIG. 3, the set screw 28 has an axis in a vertical plane 60 forwardly spaced a distance "D" from the vertical plane 62 of axes of the clamping screws 22 at a sufficient distance to allow independent access to the tool slots without interference. In packaged condition, the set screw may be furnished in a retracted position thereby allowing direct insertion of the ground wire into the J-slot, without initial retraction of the set screw.

For assembly, the clamping screws 22 are unloosened sufficiently for allowing the lower clamp 24 to engage the grounding member 14 and the upper clamp 20 to pivot about the clamping screw on end section 32 with the other clamping screw entering the slot 38 for rough assembly. Thereafter, the clamping screws are tightened progressively to a clamped position against the ground member 24, with the tang 39 preventing subsequent rotation a the slot. With the set screw 28 in a retracted position, the ground wire 12 is inserted upwardly into the J-slot and held against the recess. The set screw 28 is then tightened to clamp the ground wire against the side wall 54. Should subsequent repositioning or retightening of the screws be required, the same may be done independently with interference.

It will be appreciated that the clamp of the present invention, in both the installed and packaged condition, presents a compact clamp envelope in comparison with the prior art clamp of FIG. 6.

The above description is intended to be illustrative of the preferred embodiment, and modifications and improvements thereto will become apparent to those in the art. Accordingly, the scope of the invention should be construed solely in accordance with the appended claims.

What is claimed is:

1. A ground clamp for electrically connecting a ground wire to a parallel grounding member, said ground clamp comprising: an upper clamp member having an upper center section and outwardly extending upper end sections; a downwardly opening transverse upper groove on said upper center section having laterally opposed surfaces for engaging an upper surface of the grounding member; a lower clamp member a lower center section and outwardly extending lower end sections underlying said upper end sections of said upper clamp member; an upwardly opening transverse lower groove on said lower center section having laterally opposed surfaces for contacting a lower surface of the grounding member; a threaded hole in each of said lower end sections of said lower clamping member; a through hole in one of said upper end sections axially registering with one of said threaded holes in said lower clamping member; a transversely opening slot in the other of said upper end sections axially registering with the other of said threaded holes in said lower clamp member; a first clamping screw having a threaded shank extending through said hole in said one of said upper end sections and one of said threaded holes, and having a slotted head engaging a top surface of said one of said upper end sections; a second clamping screw having a threaded shank extending through said slot in said other of said upper end sections and the other of said threaded holes, and having a slotted head engaging a top surface of said other of said upper end sections; a boss formed integrally with said center section of said lower clamp member below said lower groove, said boss having laterally spaced side walls forming a downwardly opening slot; a recessed section formed on an inner surface of one of said side walls whereby the ground wire may be inserted through said downwardly opening slot and against said recessed section; a laterally threaded hole formed in the other of said side walls; a set screw received in said laterally threaded hole having an end portion for engaging the ground wire and clamping the ground wire against said recessed section.

2. A ground clamp for electrically connecting a ground wire to a parallel grounding member, said ground clamp comprising: an upper clamp member and a lower clamp member having opposed transversely grooved surfaces for contacting the grounding member; a pair of laterally spaced threaded clamping screws interconnecting opposed lateral end portions of said clamp members and disposed in a first vertical plane; a boss formed integrally with said lower clamp member below said grooved surface therein and projecting forwardly thereof; a downwardly opening slot formed in said boss for receiving the ground wire; a set screw transversely formed in said boss and intersecting said slot, said set screw disposed in a second vertical plane space sufficiently forward of said first vertical plane whereby said screws may be independently operated without interference from adjacent screws.

3. The ground clamp as recited in claim 2 wherein the grooved surfaces on said lower clamp member have a truncated inverted V-shape having a base surface with a top surface of said boss coextensive therewith.

4. The ground clamp as recited in claim 3 wherein said slot in said boss has a generally inverted J-shape.

* * * * *